US006211618B1

(12) United States Patent
Fancher et al.

(10) Patent No.: US 6,211,618 B1
(45) Date of Patent: Apr. 3, 2001

(54) ARC DISCHARGE LAMP WITH BIMETAL STRIP FOR FAST PASSIVE LAMP FAILURE

(75) Inventors: Stephen C. Fancher, Clarksburg; Thomas O. Leyh, Bridgeport, both of WV (US)

(73) Assignee: Philips Electronics North America Corp., New York, NY (US)

( * ) Notice: Subject to any disclaimer, the term of this patent is extended or adjusted under 35 U.S.C. 154(b) by 0 days.

(21) Appl. No.: 09/300,700

(22) Filed: Apr. 27, 1999

(51) Int. Cl.[7] ..... H01J 7/44
(52) U.S. Cl. ..... 315/49; 313/479; 313/482
(58) Field of Search ..... 315/49, 73, 76; 313/479, 477 R, 482, 613, 614, 619, 620, 621

(56) References Cited

U.S. PATENT DOCUMENTS 4,659,966 * 4/1987 Roche ..... 315/73
4,709,187 * 11/1987 Roche ..... 315/73
5,004,949 * 4/1991 Latassa et al. ..... 313/482
5,057,741 * 10/1991 Barakitis et al. ..... 313/619

* cited by examiner

*Primary Examiner*—Don Wong
*Assistant Examiner*—Thuy Vinh Tran
(74) *Attorney, Agent, or Firm*—Dicran Halajian

(57) ABSTRACT

Fluorescent tube type discharge lamp has end sealed in base with terminal pins connected to lead wires passing through stem press and supporting an electrode in the form of a coil having an emitter. Bimetal strip has a first end welded to one of the leads and a second end proximate to a thin walled portion of the stem. When electrode fails and an arc discharge operates directly off the leads, the bimetal strip heats up so that second end contacts thin walled portion and arcs through to admit air for passive failure of lamp.

4 Claims, 2 Drawing Sheets

ARC DISCHARGE LAMP WITH BIMETAL STRIP FOR FAST PASSIVE LAMP FAILURE

BACKGROUND OF THE INVENTION

The invention relates to an arc discharge lamp of the type including a base having an insulator therein, a pair of terminals fixed in said insulator, a light transmissive arc tube having an end, and a glass stem sealed in the end, the stem including a stem press and a thin walled portion attached to the arc tube. A pair of leads connected to respective terminals extend through the press seal into the arc tube, where an electrode is connected between the leads. A conductor fixed to a lead wire in the arc tube extends toward a thin walled portion of the stem to assure fast passive lamp failure.

When an electrode in the form of a filament connected between the lead wires of an arc discharge lamp fails, typically when an electron emitter thereon for sustaining a discharge between opposite ends of the lamp is depleted, the arc discharge operates directly off the lead wires. This causes overheating of the electrode structure and elevated arc tube (bulb wall) temperatures. This overheating may cause the electrode structure to fall against the arc tube. It is also possible that the lamp might simply flicker, or the ballast might overheat and fail.

The failure problem can be exacerbated when a discharge lamp is used with a ballast which is not designed optimally for use with the lamp. For example, a type F32T8 fluorescent tube works best, from a standpoint of lifetime, lumen maintenance, and dimming capabilities, with a "rapid start" type ballast. However "instant start" type ballasts have become increasing popular because of their lower cost and reduced power consumption, and the standard fluorescent tubes are fitted in fixtures having the instant start ballasts. This has been found to decrease the lifetime of the lamp by as much as 25%.

The failure process of F32T8 lamps on a high frequency instant start ballast at end of life is as follows. When the electrode and emission material thereon are depleted, the source of electrons which sustains the discharge throughout normal life is also depleted. With an Instant Start HF ballast enough open circuit voltage is available to ignite an arc discharge and operate from the lead wires which held the filament. However the lead wires have a much higher work function than the electrode and emitter, so it takes far more energy to extract electrons. This extra energy heats the metal parts and the surrounding glass to a very high temperature. This causes the glass in the stem press to soften, which allows the supporting structure of the shield to sag, which allows the shield to become shorted to a lead wire. The shield then becomes the cold cathode, which also has a very high work function and heats the surrounding glass.

U.S. Pat. No. 3,265,917 discloses an arc discharge lamp having a conductor welded to an electrode and extending toward the thin walled portion of the stem. It was found that proper placement of a conductor would cause arcing between the end of the conductor and the thin walled portion of the stem, causing it to melt and admit air which rapidly extinguished the arc. However the positioning of the conductor must be very precise; the end should actually be touching the glass in order to strike an arc which burns through the thin-walled portion. Such precise positioning can be problematic from a manufacturing standpoint.

SUMMARY OF THE INVENTION

According to the invention, the conductor is a bimetal strip having a first end welded to one of the lead wires and a second end proximate the thin-walled portion of the stem. The bimetal strip is arranged so that the second end bends toward the thin-walled portion when it is heated by the arc discharge which occurs on the lead wires when the electrode has failed.

Use of a bimetal strip assures that the end of the conductor will contact the thin-walled portion of the stem to cause arc-through and passive failure of the lamp.

DETAILED DESCRIPTION OF THE PREFERRED EMBODIMENTS

Figure 1:
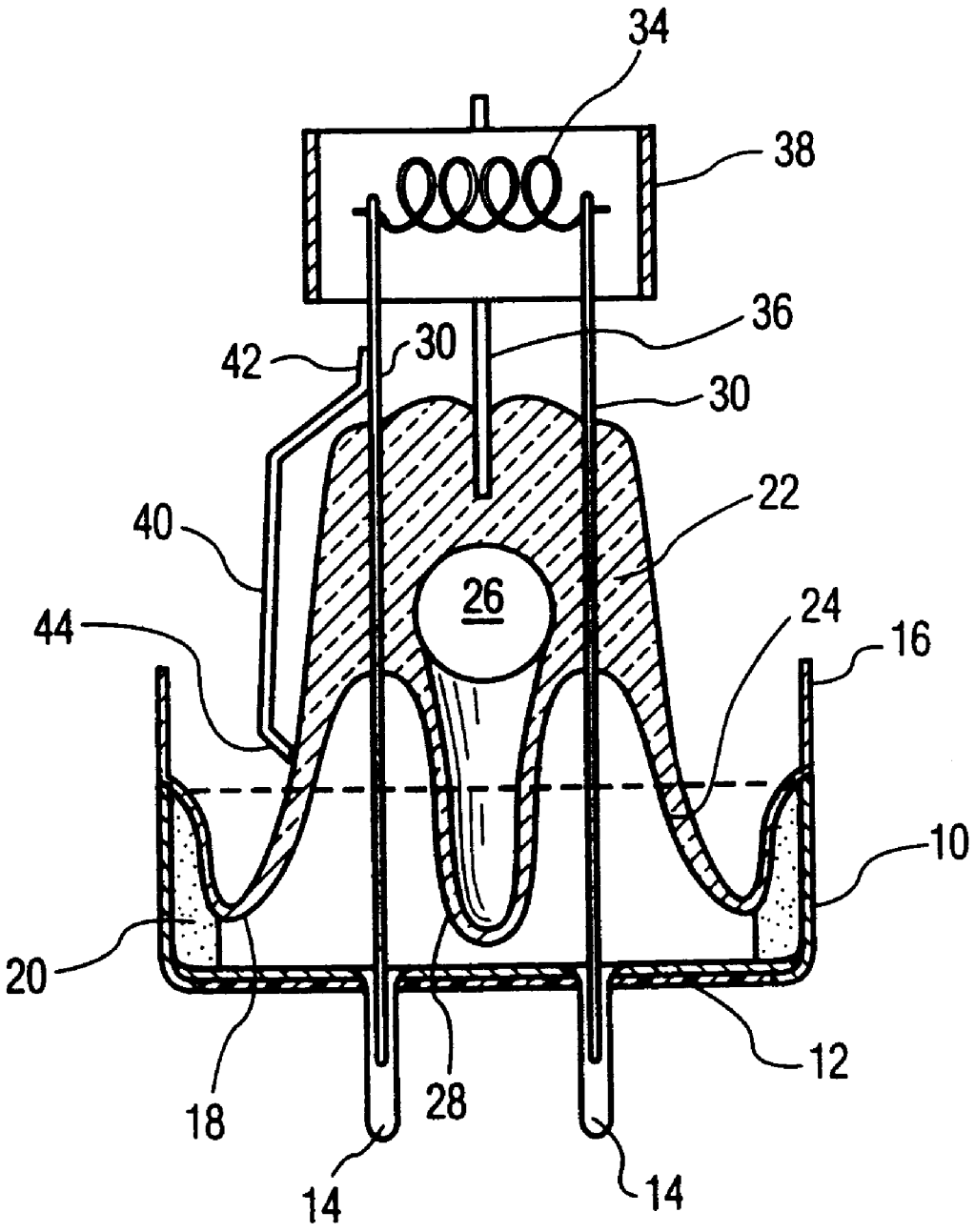
FIG. 1 is a side view of the end of a fluorescent lamp according to the invention.
Figure 2:
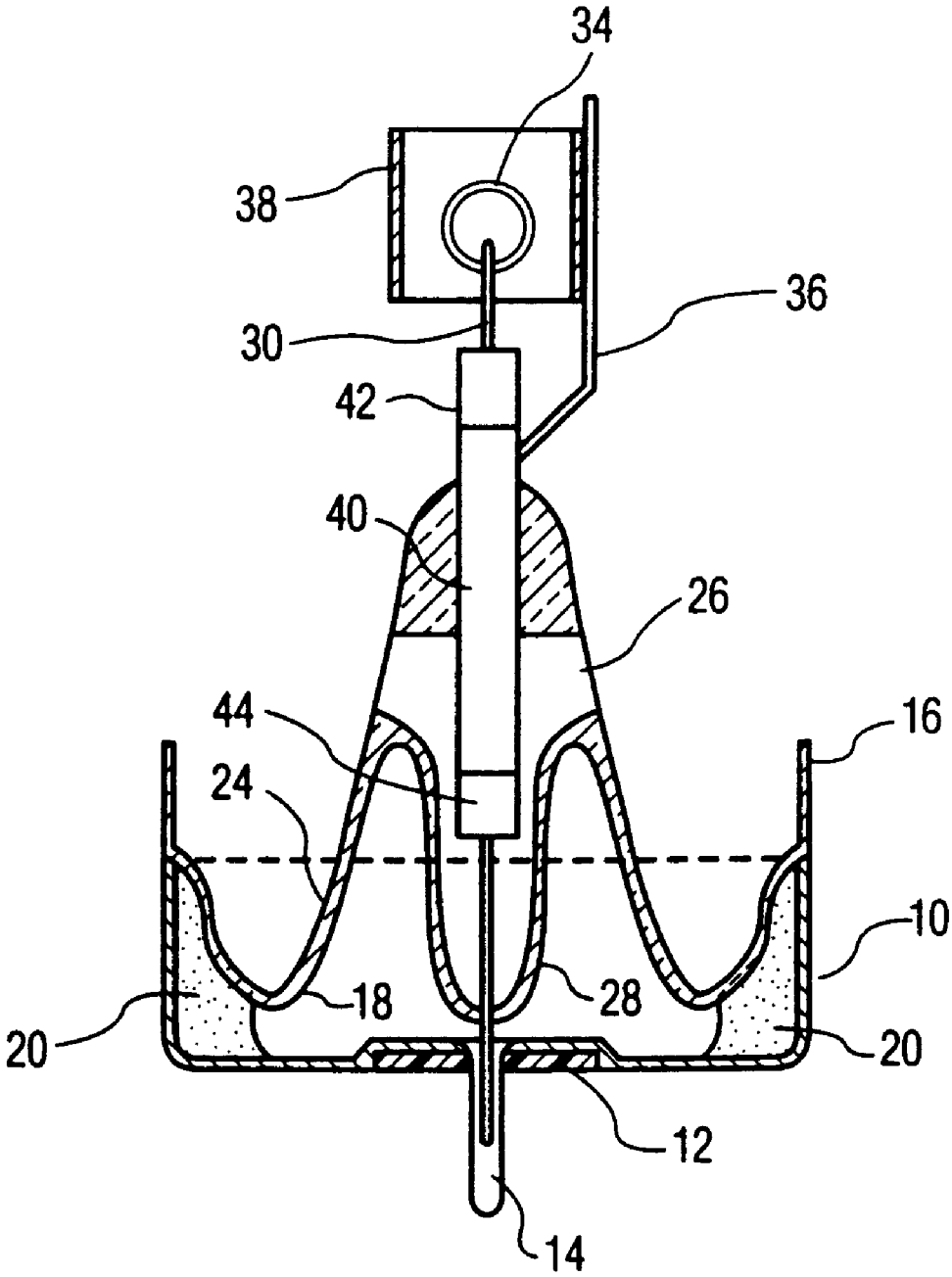
FIG. 2 is an end view of the end of a fluorescent lamp according to the invention.

Referring to the figures, the end of an arc discharge lamp of the type commonly referred to as a fluorescent tube includes a stamped and formed aluminum base 10 having a phenolic resin insulator 12 fitted therein; a pair of terminals 14 are fixed in the insulator 12 and pass through the base 10.

An arc discharge vessel in the form of a glass tube 16 having an end 18 is fixed in the base 10 with potting compound 20. A glass stem includes a stem press 22 and a thin-walled portion 24 which is sealed to the end of the lamp vessel in the base. A hole 26 in the stem press 22 connects with an exhaust tube 28 which is used to draw vacuum in the lamp (1–4 Torr) during manufacture.

A pair of leads 30 are connected to respective terminals 14 and embedded in the stem press 22 which serves as a seal. Inner portions of the lead wires 30 support an electrode 34 in the form of a double coil coated with an emitter. A center lead 36 embedded in the stem press 22 supports a shield 38 which surrounds the electrode 34.

A conductor in the form of a bimetal strip 40 has a first end 42 welded to one of the leads inside the lamp vessel and extends to a second end 44 proximate to the thin-walled portion 24. When the electrode fails and the arc discharge occurs on the inner ends of the leads 30, heat causes the bimetal strip to bow so that the second end 44 touches the thin walled portion, thus striking an arc which burns through the thin-walled portion and admits air which extinguishes the arc. Passive failure is thus achieved without the inner lead sagging against the shield, and without danger of fracturing the glass tube 16.

The foregoing is exemplary and not intended to limit the scope of the claims which follow.

What is claimed is:

1. A discharge lamp comprising a base having an insulator therein, a pair of terminals fixed in said insulator and passing through said base, a light transmissive arc tube having an end fixed in said base, a glass stem in said end, said stem comprising a stem press and a thin walled portion attached to said arc tube, a pair of leads connected to respective terminals and extending through said stem press into said arc tube, an electrode connected between said leads, and a bimetal strip having a first end welded to one of said leads and a second end proximate said thin walled portion of said stem, said bimetal strip being arranged so that said second end bends toward said thin walled portion when it is heated by an arc discharge which occurs on said leads when said electrode fails.

2. A discharge lamp as in claim 1 wherein said bimetal strip is arranged so that it touches said thin walled portion when said electrode fails.

3. A discharge lamp as in claim 1 wherein said stem further comprises an exhaust tube arranged centrally of said thin walled portion and having a closed end toward said base.

4. A discharge lamp as in claim 1 further comprising a cathode shield adjacent to said electrode and a central lead fixed in said stem press and supporting said shield.

* * * * *